US005911416A

United States Patent [19]

Klopfenstein

[11] Patent Number: 5,911,416

[45] Date of Patent: Jun. 15, 1999

[54] VARIABLE HEIGHT POCKET FOR SHEET MATERIAL CONVEYING APPARATUS

[75] Inventor: Andrew L. Klopfenstein, Tipp City, Ohio

[73] Assignee: Heidelberg Finishing Systems, Inc., Dayton, Ohio

[21] Appl. No.: 08/719,863

[22] Filed: Sep. 25, 1996

[51] Int. Cl.[6] ..... B65H 31/20; B65H 39/00

[52] U.S. Cl. ..... 271/223; 270/58.25; 270/58.06

[58] Field of Search ..... 271/279, 296, 271/299, 223; 270/52.14, 52.2, 58.23, 58.01, 58.18, 58.19, 58.28, 58.06, 58.025; 414/790.5, 790.6, 790.4

[56] References Cited

U.S. PATENT DOCUMENTS

| | | | |
|---|---|---|---|
| 4,124,203 | 11/1978 | Muller | 270/55 |
| 4,721,296 | 1/1988 | Mowry | 270/55 |
| 4,988,086 | 1/1991 | Schlough | 270/55 |
| 5,172,802 | 12/1992 | Wells | 198/477.1 |
| 5,251,888 | 10/1993 | Eugster . | |
| 5,527,025 | 6/1996 | Schlough . | |

*Primary Examiner*—William E. Terrell
*Assistant Examiner*—Wonki Park
*Attorney, Agent, or Firm*—Tarolli, Sundheim, Covell, Tummino & Szabo

[57] ABSTRACT

A sheet material conveying apparatus includes a plurality of sheet material feeders. A plurality of pockets are movable past each of the sheet material feeders in turn to sequentially feed sheet material into the pockets. Each pocket has an upper end portion through which sheet material enters the pocket, a lower end portion through which sheet material leaves the pocket, and a support which supports sheet material in the pocket. The support is movable between a plurality of closed positions in which the support is spaced different distances from the upper end portion of the pocket and at least partially blocks the lower end portion of the pocket. The support is movable from each of the closed positions to an open position in which sheet material is movable out of the pocket through the lower end portion of the pocket. The pocket includes a rack and a pinion which are relatively movable to move the support between each of the closed positions and the open position.

13 Claims, 8 Drawing Sheets

VARIABLE HEIGHT POCKET FOR SHEET MATERIAL CONVEYING APPARATUS

BACKGROUND OF INVENTION

1. Technical Field

The present invention relates to a sheet material conveying apparatus. In particular, the present invention relates to a pocket for conveying sheet material, such as signatures, in a collating system.

2. Description of the Prior Art

A known sheet material conveying apparatus includes a plurality of pockets which are driven for movement past a plurality of signature feed mechanisms. Each one of the signature feed mechanisms deposits a signature into a pocket travelling underneath the feed mechanism. In this manner, as each pocket sequentially travels past the plurality of feed mechanisms, collated assemblages of signatures are formed in the pockets. The pockets are then opened to allow the collated assemblages of signatures to drop out of the pockets for further handling.

The signatures are typically deposited into the pockets in a folded condition with the folded edge down and the lap edge up. The lap edge of the signature is then subject to further handling and must be at a particular position, or height, relative to the upper end portion of the pocket. Different types of signatures may have a different distance, or height, between the folded edge and the lap edge. The pockets should be adjustable in some manner to compensate for the different signatures.

SUMMARY OF THE INVENTION

The present invention is a sheet material conveying apparatus comprising a plurality of sheet material feeders and a plurality of pockets movable past each of the sheet material feeders in turn to sequentially feed sheet material into the pockets. Each pocket includes a cam follower supported for movement on the pocket and a cam engageable by the cam follower to effect movement of the cam follower on the pocket. Each pocket has an upper end portion through which sheet material enters the pocket, a lower end portion through which sheet material leaves the pocket, and a support which supports sheet material in the pocket. The support is movable between a plurality of closed positions in which the support is spaced different distances from the upper end portion of the pocket and at least partially blocks the lower end portion of the pocket. The support is movable from each of the closed positions to an open position in which sheet material is movable out of the pocket through the lower end portion of the pocket. The pocket includes gear drive means for effecting movement of the support from the open position to a selected one of the closed positions in response to movement of the cam follower on the pocket. In a preferred embodiment, the gear drive means includes a rack, a pinion in meshing engagement with the rack, and means for effecting relative movement between the rack and the pinion to move the support between each of the closed positions and the open position.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF A PREFERRED EMBODIMENT OF THE INVENTION

Figure 1:
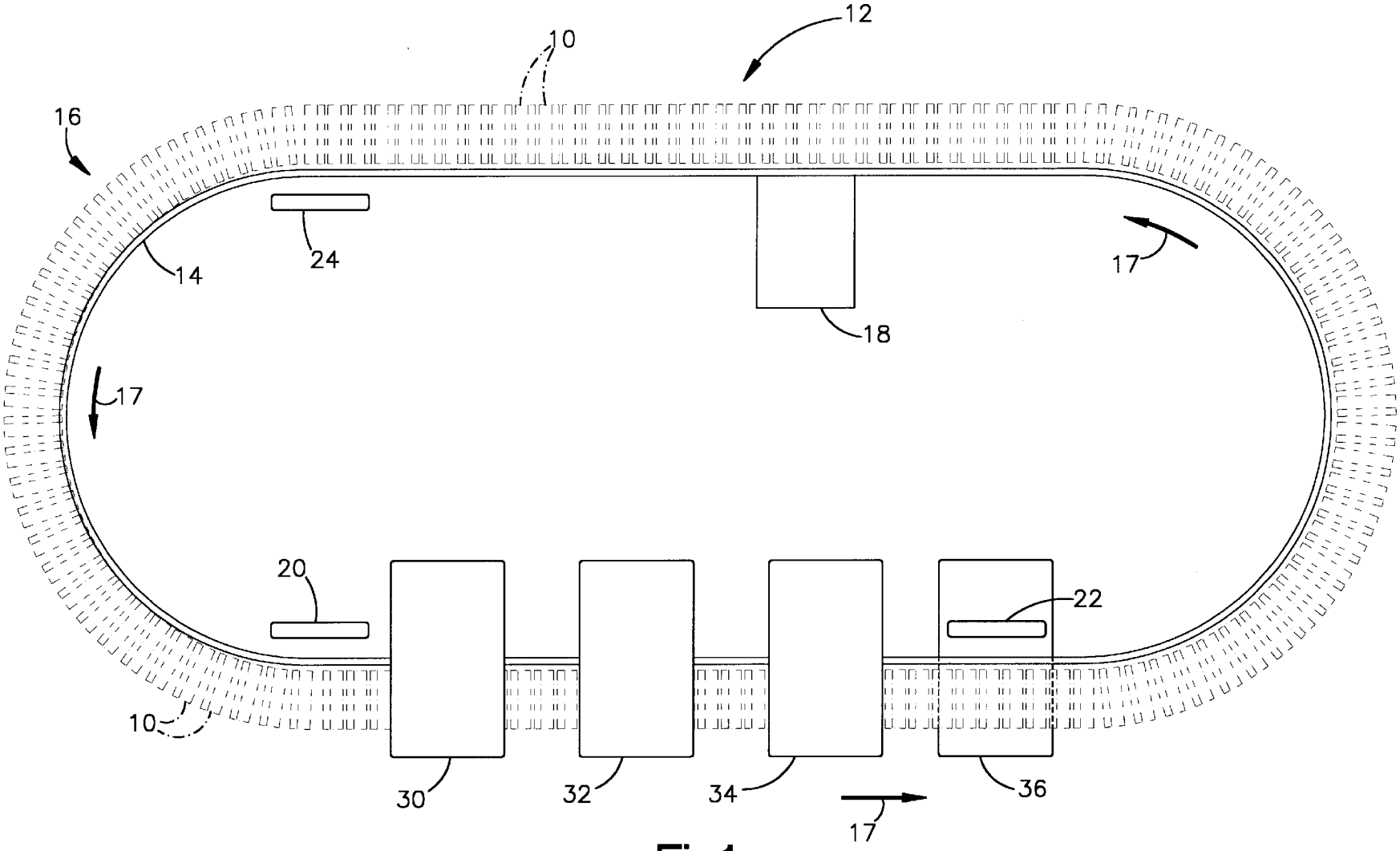
FIG. 1 is a schematic illustration of a collating system including a plurality of pockets constructed in accordance with the present invention.

The present invention relates to a sheet material conveying apparatus. In particular, the present invention relates to a pocket for conveying sheet material, such as signatures, in a collating system. As representative of the present invention, FIG. 1 illustrates schematically a plurality of identical pockets 10 which form part of a sheet material conveying apparatus or collating system 12.

The collating system 12 includes support means indicated schematically at 14, such as a conveyor, which supports the pockets 10 for movement along a closed, oval-shaped loop 16 in a direction of travel indicated by the arrows 17. It should be understood that collating systems including pockets 10 in accordance with the present invention could extend in more than one plane and/or could extend in other configurations.

The collating system 12 includes drive means indicated schematically at 18 for driving the pockets 10, in a manner not shown, along the loop 16. A lift cam 20, a trip cam 22, and a pawl reset cam 24 are located at predetermined positions along the loop 16. The cams 20, 22 and 24 are engageable by the pockets 10, in a manner described below, to control the opening and closing of the pockets.

A jacket delivery station 30, an opener station 32, and an insert delivery station 34 are spaced along the loop 16. As each pocket 10 sequentially travels past the stations 30, 32 and 34, assemblages of jackets and inserts are formed in the pockets. After the collated assemblages are completed in the pockets 10, the pockets are opened at a discharge station 36, in a manner described below, to allow the collated assemblages to drop downward from the pockets for further handling in a known manner.

Figure 3:
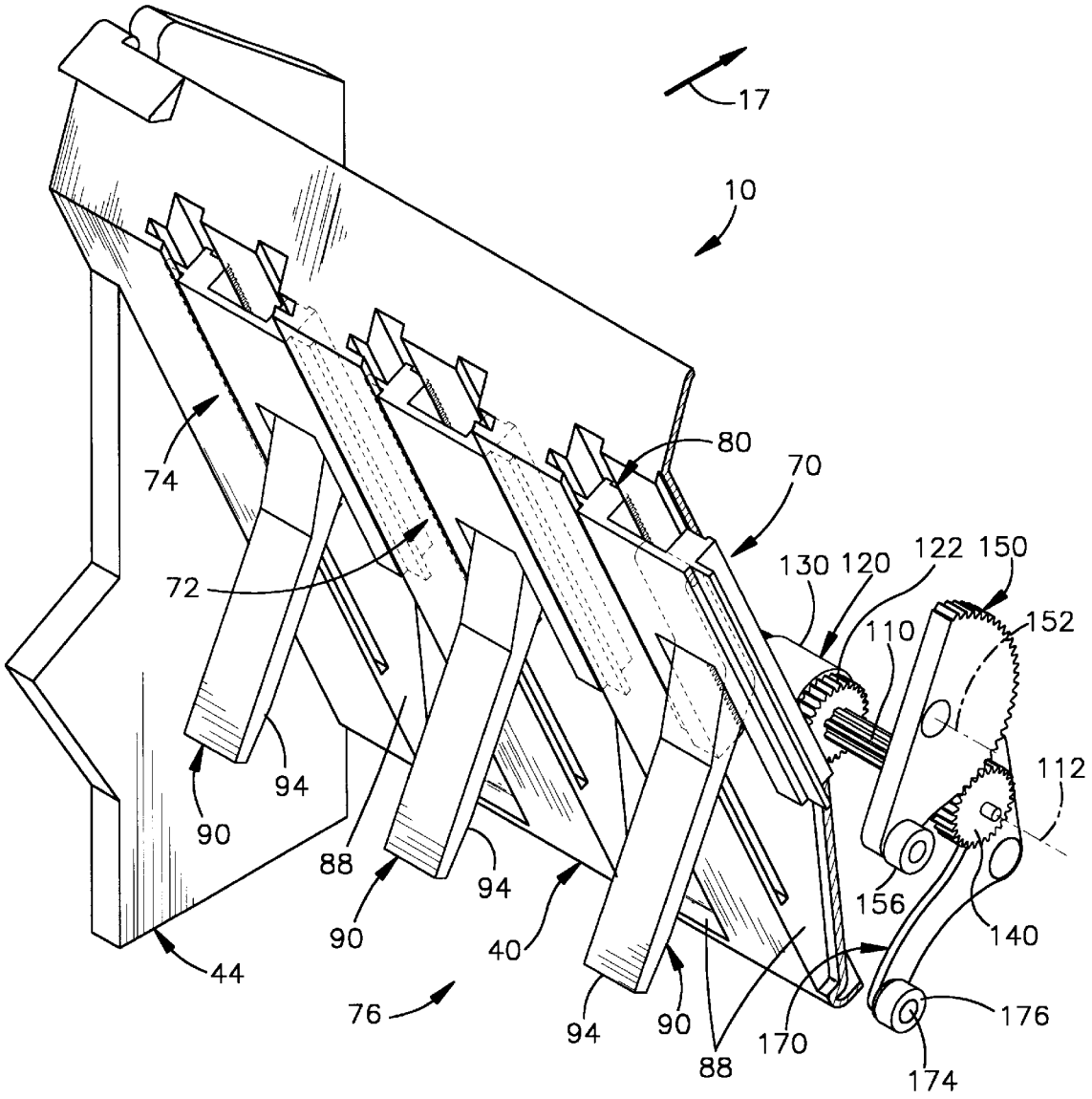
FIG. 3 is a cutaway perspective view of the pocket of FIG. 2.
Figure 4:
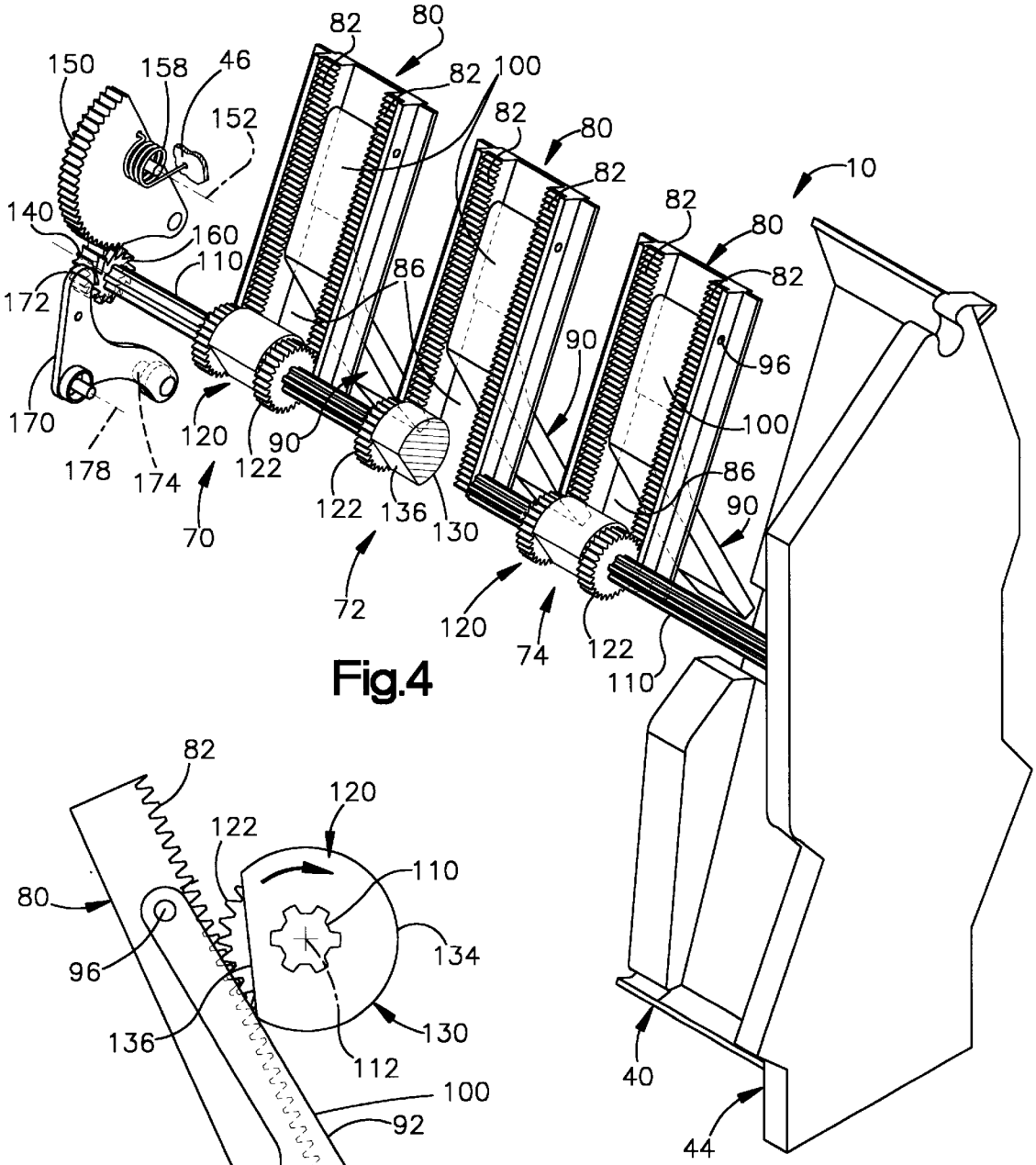
FIG. 4 is another cutaway perspective view of the pocket of FIG. 2.

Each pocket 10 (FIGS. 2–4) includes a front wall 40 which leads when the pocket moves along the support means 14 in the direction of travel 17. Each pocket 10 also includes a back wall 42 and opposite side walls 44 and 46. The pocket walls 40–46 are preferably made from a plastic material.

The pocket 10 has an upper end portion 50 through which sheet material, such as jackets or inserts, is deposited into the pocket 10. The upper end portion 50 of the pocket 10 includes an upper end portion 52 of the front wall 40 and an upper end portion 54 of the back wall 42. An open space 56 in the pocket 10 is defined between the front wall 40 and the back wall 42. The pocket 10 also has a lower end portion 60 through which sheet material is discharged from the pocket. The lower end portion 60 of the pocket 10 includes a lower end portion 62 of the front wall 40 and a lower end portion 64 of the back wall 42.

The pocket 10 includes three support assemblies 70, 72 and 74 which are movable between an open condition and a plurality of closed conditions. The support assemblies 70–74 have portions, described below, which form a movable bottom wall 76 of the pocket 10. When the support assemblies 70–74 are in the open condition, the bottom wall 76 of the pocket 10 is in an open position and the lower end portion 60 of the pocket is open. Sheet material in the pocket 10 can drop out of the pocket through the open lower end portion 60 of the pocket. When the support assemblies 70–74 are in any one of the closed conditions, the bottom wall 76 of the pocket 10 is in a closed position and the lower end portion 60 of the pocket is closed. Sheet material in the pocket 10 is blocked from movement out of the pocket through the lower end portion 60 of the pocket.

Because the three support assemblies 70–74 are identical, the following description of the pocket 10, at times, refers to the parts and operation of only one of the support assemblies. It should be understood that all the support assemblies 70–74 are constructed in the same manner and move in synchronism with each other between the open and closed conditions.

The support assemblies 70–74 are mounted on the front wall 40 of the pocket 10. Each one of the support assemblies 70–74 includes a rack 80. The rack 80 is supported for sliding movement along the front wall 40 of the pocket 10 in a generally vertical direction, that is, upward or downward as viewed in FIG. 2. The rack 80 is preferably made from a plastic material, such as NYLATRON NSB (™), which is available from The Polymer Corporation of Reading, Pa.

Two linear arrays of rack teeth 82 are formed on a side of the rack 80 facing in a direction away from the back wall 42 of the pocket 10. A central opening 86 in the rack 80 extends between the lower end portions of the arrays of rack teeth 82. The opening 86 is coextensive with an opening 88 in the front wall 40 of the pocket 10.

Figure 2:
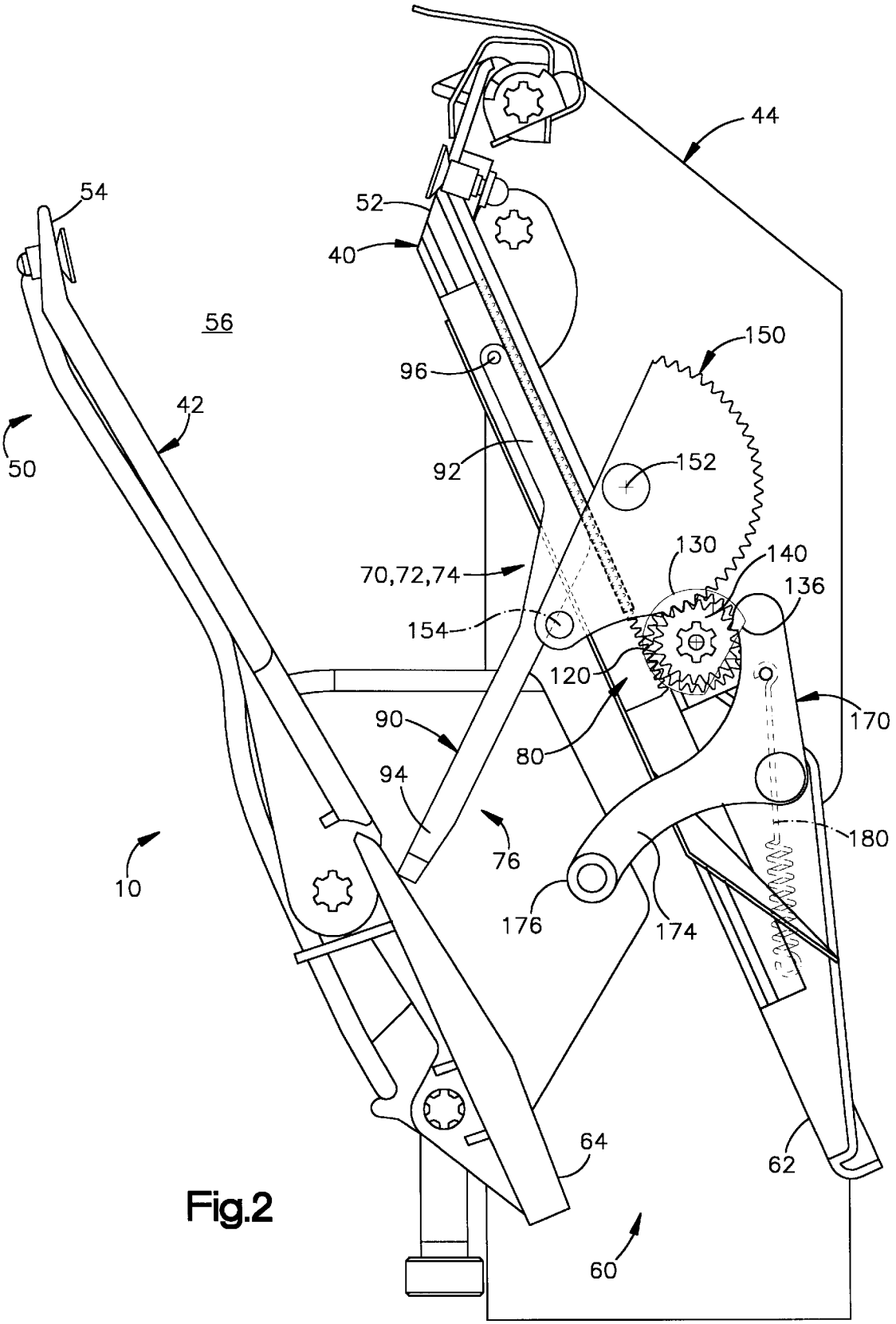
FIG. 2 is a schematic side view of one of the pockets of FIG. 1.

Each one of the support assemblies 70–74 includes a movable support or foot 90. The foot 90 is preferably made from a plastic material, such as nylon 6/6 with 50% long glass fill. The foot 90 has a generally V-shaped configuration as viewed from the side of the pocket 10 (FIG. 2). The V-shaped configuration of the foot 90 includes a first or upper portion 92. A second or lower portion 94 of the foot 90 extends at an angle of about 45 degrees to the upper portion 92. The lower portion 94 of the foot 90 is relatively long compared to the upper portion 92. The lower portions 94 of the feet 90 together form the movable bottom wall 76 (FIG. 3) of the pocket 10.

The upper portion 92 of the foot 90 is supported on pivot pins 96 (FIGS. 2, 4 and 6) in the front wall 40 of the pocket 10, at a location above the central opening 86 in the rack. The pivot pins 96 support the foot 90 on the rack 80 for pivotal movement relative to the rack, at a location between and parallel to the arrays of rack teeth 82. The lower portion 94 of the foot 90 is extendible, in a manner described below, through the central opening 86 in the rack 80 and the opening 88 in the pocket wall 40, into the open space 56 between the front and back walls 40 and 42 of the pocket. A biasing spring (not shown) acting between the foot 90 and the rack 80 biases the foot 90 into a closed position relative to the rack (FIGS. 3 and 7) as described below.

The foot 90 has a lifting surface 100 (FIG. 6) which extends along the side of the foot 90 facing away from the back wall 42 of the pocket 10. A first planar portion of the lifting surface 100 extends along the first or upper portion 92 of the foot 90. A second planar portion of the lifting surface 100 extends along the second or lower portion 94 of the foot 90.

The pocket 10 includes a splined drive shaft 110 (FIGS. 3 and 4) which is supported on the side walls 44 and 46 of the pocket 10 for rotation about a drive axis 112.

The drive shaft 110 extends the width of the pocket 10, that is, past all three support assemblies 70–74. The drive shaft 110 is preferably made from aluminum.

Each support assembly 70–74 includes a cylindrical pinion 120 fixed on the drive shaft 110 for rotation with the drive shaft. The pinion 120 is preferably formed as one piece from a plastic material, such as NYLATRON NSB (™). The pinion 120 includes two arcuate arrays of gear teeth 122 spaced apart along the drive shaft 110, on opposite sides of the lifting surface 100 on the foot 90. Each arcuate array of gear teeth 122 on the pinion 120 is in meshing engagement with a respective linear array of rack teeth 82 on the rack 80.

A driver cam 130 is formed as one piece with the pinion 120 and is, thereby, fixed on the drive shaft 110 for rotation with the drive shaft. The driver cam 130 is disposed intermediate the two arrays of gear teeth 122 on the pinion 120. The driver cam 130 has a generally D-shaped outer peripheral surface (FIG. 6) which is engageable with the lifting surface 100 on the foot 90. The outer peripheral surface of the driver cam 130 includes an arcuate cam surface 134 and a planar cam surface 136.

Adjacent one end of the drive shaft 110 a drive gear 140 (FIG. 3) is fixed for rotation with the drive shaft. The drive gear 140 is preferably made from powder metal. An actuator gear or sector gear 150 has an arcuate array of gear teeth in meshing engagement with the drive gear 140. The sector gear 150 is supported on a side wall of the pocket 10 for rotation about an axis 152 spaced from the drive axis 112. The sector gear 150 is preferably made from a plastic material.

The sector gear 150 includes a lift cam follower arm 154 (FIG. 2). A lift cam follower 156 (FIG. 3) is supported for rotation on the lift cam follower arm 154. The lift cam follower 156 is engageable with the lift cam 20 (FIG. 1), in a manner described below, to rotate the sector gear 150 about the axis 152 and, thereby, to effect rotation of the drive gear 140. A biasing spring shown schematically at 158 extends between the sector gear 150 and a portion of the side wall 46 of the pocket 10. The biasing spring 158 biases the sector gear 150 for rotation in a counterclockwise direction as viewed in FIG. 4 (a clockwise direction as viewed in FIGS. 2–3 and 5–8).

A ratchet wheel 160 is fixed on the drive shaft 110 for rotation with the drive shaft. The ratchet wheel 160 is disposed adjacent to the drive gear 140. The ratchet wheel 160 is preferably formed as one piece with the drive gear 140. The ratchet wheel 160 has a series of external ratchet teeth.

Figure 11:
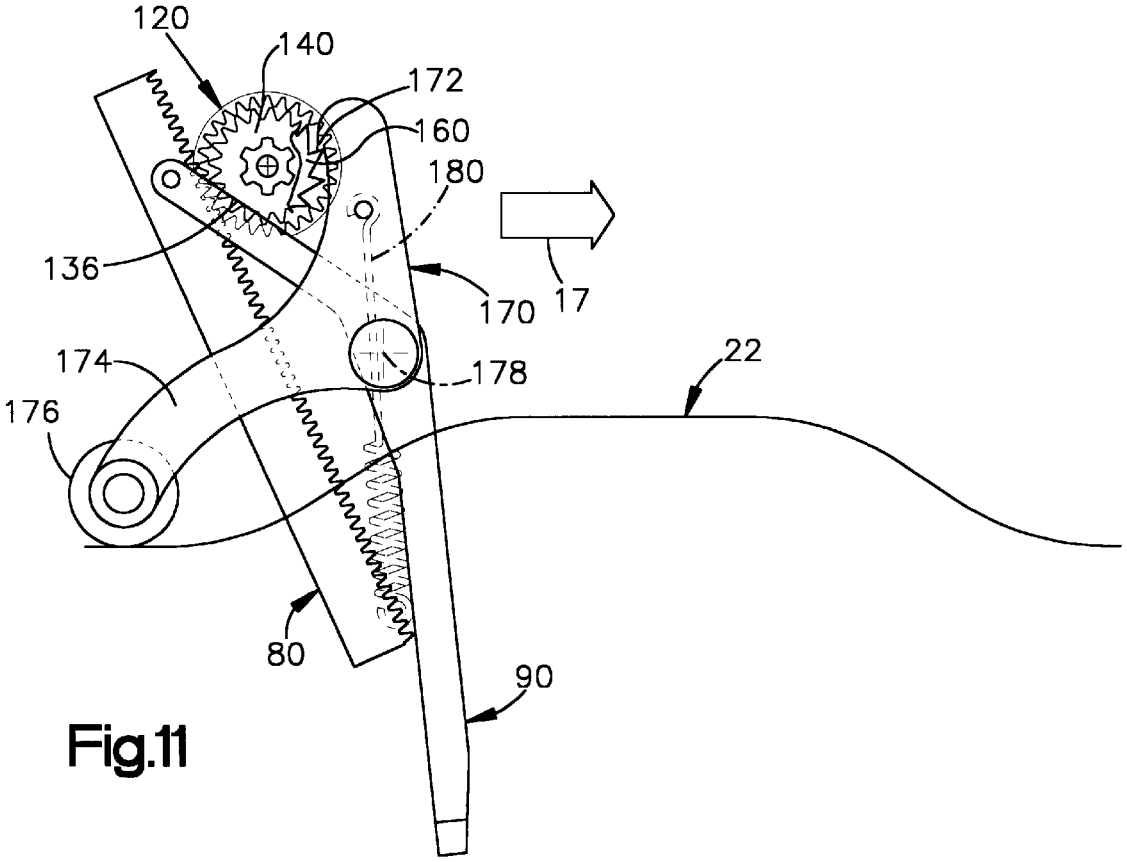
FIGS. 11–13 are schematic views illustrating the cam actuated opening of the pocket.

A pawl 170 is supported on the side wall 46 of the pocket 10 for pivotal movement relative to the ratchet wheel 160 about a pivot axis 178. The pawl 170 is preferably made from stamped steel and has a pawl tooth 172 which is engageable with the ratchet teeth on the ratchet wheel 160. When the pawl tooth 172 is in engagement with the ratchet wheel 160, as shown in FIG. 11, the pawl 170 blocks rotation of the ratchet wheel about the drive axis 112 in a counterclockwise direction as viewed in FIG. 11.

Figure 13:
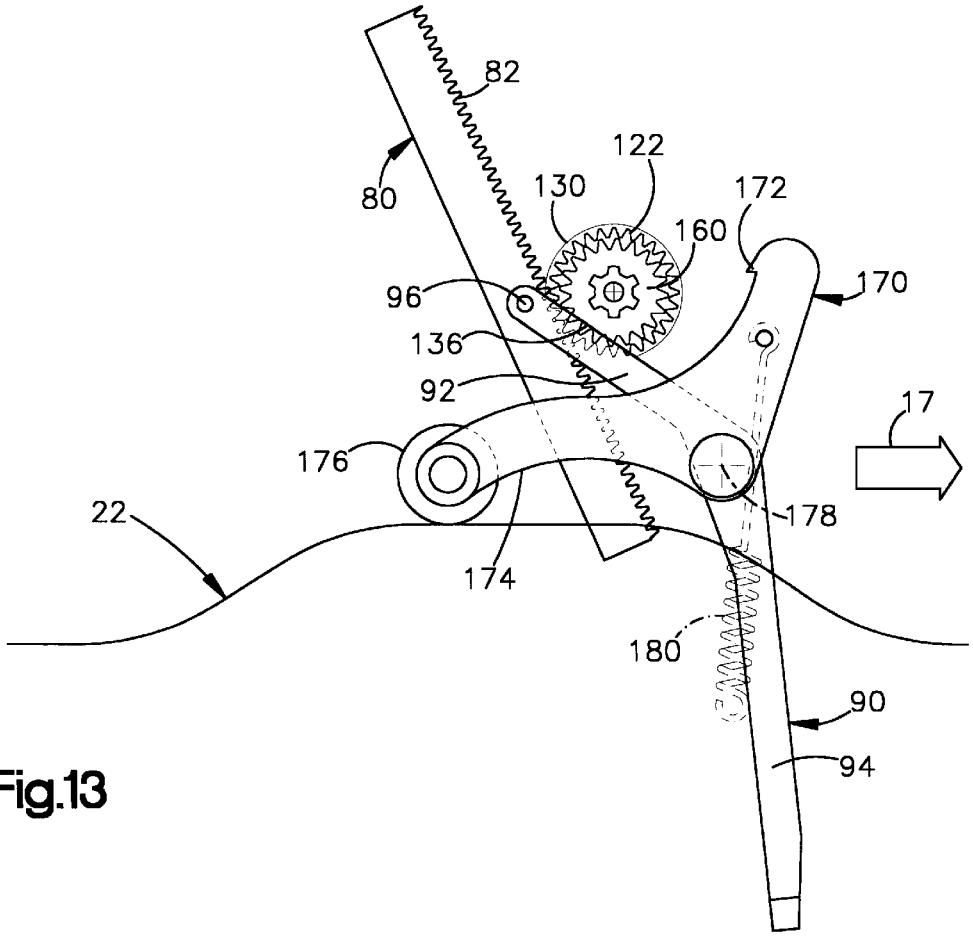

The pawl 170 has a trip cam follower arm 174. A trip cam follower 176 is supported for rotation on the trip cam follower arm 174. The trip cam follower 176 is engageable with the trip cam 22 (FIG. 1), in a manner described below, to pivot the pawl 170 from the engaged position shown in FIG. 11 to a disengaged position, shown in FIG. 13, spaced apart from the ratchet wheel 160.

An overcenter spring 180 extends between the pawl 170 and the side wall 46 of the pocket 10. The overcenter spring 180 holds the pawl 170 in the engaged position against the ratchet wheel 160 when the pawl is in the engaged position. When the pawl 170 is in the disengaged position, the overcenter spring 180 holds the pawl in the disengaged position spaced apart from the ratchet wheel 160.

The lift cam 20 (FIGS. 1 and 8–10) is disposed along the conveyor loop 16 at a predetermined position upstream of the stations 30, 32 and 34. The lift cam 20 is engageable by the lift cam follower 156 on the sector gear 150 when the pocket 10 moves along the loop 16 in the direction of travel toward the stations 30, 32 and 34. The lift cam 20 (shown schematically in FIG. 10) has a fixed first portion 190. A movable second portion 192 of the lift cam 20 is selectively positionable vertically relative to the first portion 190 to control the rise of the lift cam.

The trip cam 22 (FIGS. 1, 11 and 13) is disposed along the conveyor loop 16 at the release station 36. The trip cam 22 is engageable by the trip cam follower 176 on the pawl 170 when the pocket 10 moves along the loop 16 to arrive at the release station 36.

The pawl reset cam 24 (FIG. 22) is disposed along the conveyor loop 16 at a predetermined position downstream of the release station 36 and upstream of the lift cam 20. The pawl reset cam 24 is engageable by the trip cam follower 176 on the pawl 170 after the pocket 10 passes the release station 36. The pawl reset cam can be a mirror image of the trip cam 22.

Figure 5:
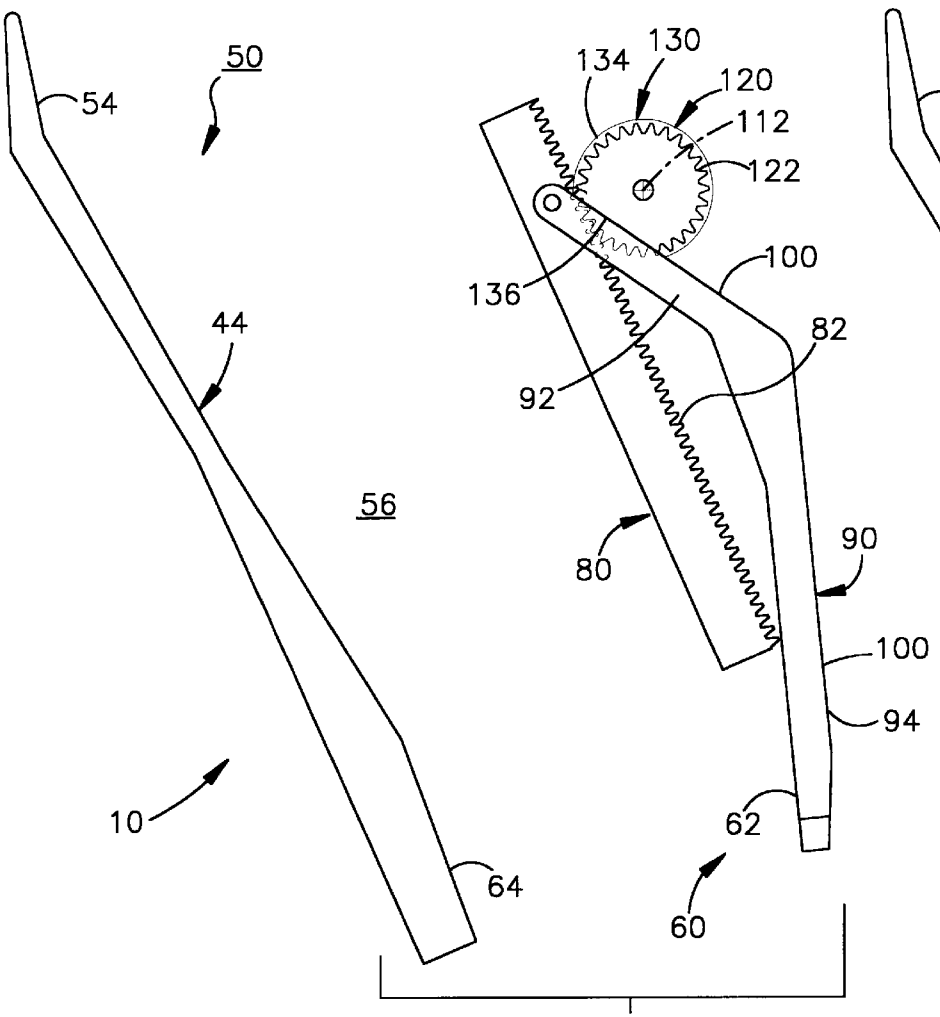

The pocket 10 has an open condition as viewed in FIG. 5. When the pocket 10 is in the open condition, each one of the support assemblies 70–74 is in an open condition. The rack 80 is at its lowest position relative to the front wall 40 of the pocket 10. The lifting surface 100 on the foot 90 is in engagement with the planar cam surface 136 on the driver cam 130. The upper portion 92 of the foot 90 extends outward from the front wall 40 of the pocket 10 in a direction away from the back wall 42 of the pocket. The lower portion 94 of the foot 90 extends from the upper portion 92 back to the plane of the front wall 40 of the pocket 10. The foot 90 is not in the open space 56 between the front wall 40 and the back wall 42 of the pocket 10. The bottom wall 76 of the pocket 10, and thereby the lower end portion 60 of the pocket, is open. Sheet material in the pocket 10 can drop or move out of the pocket through the lower end portion 60 of the pocket.

When the pocket 10 moves in the direction of travel 17 along the loop 16 and arrives at the lift cam 20 (FIG. 8), the lift cam follower 156 on the sector gear 150 engages the lift cam. The lift cam follower 156 is forced downward by the lift cam 20. The downward movement of the lift cam follower 156 causes the sector gear 150 to rotate about the axis 152 in a counterclockwise direction as viewed in FIGS. 8 and 9. The drive gear 140, which is in meshing engagement with the sector gear 150, rotates about the drive axis 112 in the opposite direction, that is, in a clockwise direction as viewed in FIGS. 8 and 9.

Because the drive gear 140 is fixed on the drive shaft 110, the drive shaft rotates about the drive axis 112 in the same direction as the drive gear. The pinion 120 also rotates with the drive shaft 110 about the drive axis 112. The rotation of the pinion 120 causes the rack 80, which is in meshing engagement with the pinion, to move relative to the pinion 120.

The rack 80 moves upward along the front wall 40 of the pocket 10 as illustrated schematically in FIGS. 5–9. As the rack 80 moves upward, it pulls its associated foot 90 upward. At the same time, the driver cam 130 is rotating because it is fixed to the drive shaft 110. Because the lifting surface 100 on the foot 90 is in engagement with the planar cam surface 136 on the driver cam 130, the rotation of the driver cam initially causes the foot 90 to pivot about the pivot pins 96, relative to the rack 80, as the foot moves upward. As the foot 90 pivots, the lower portion 94 of the foot moves through the central opening 86 in the rack 80 into the space 56 between the front wall and the back wall 42 of the pocket 10.

Figure 6:
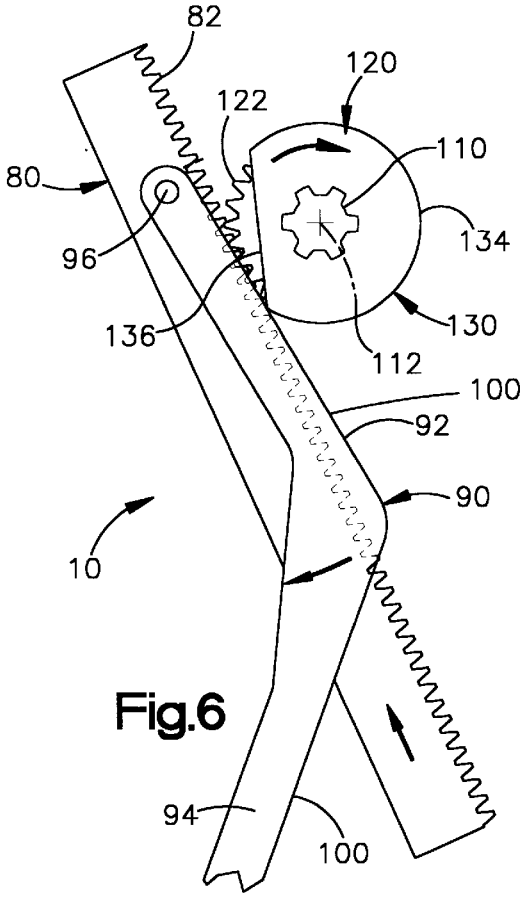
FIGS. 5–7 are schematic views illustrating the closing of the bottom wall of the pocket.
Figure 7:
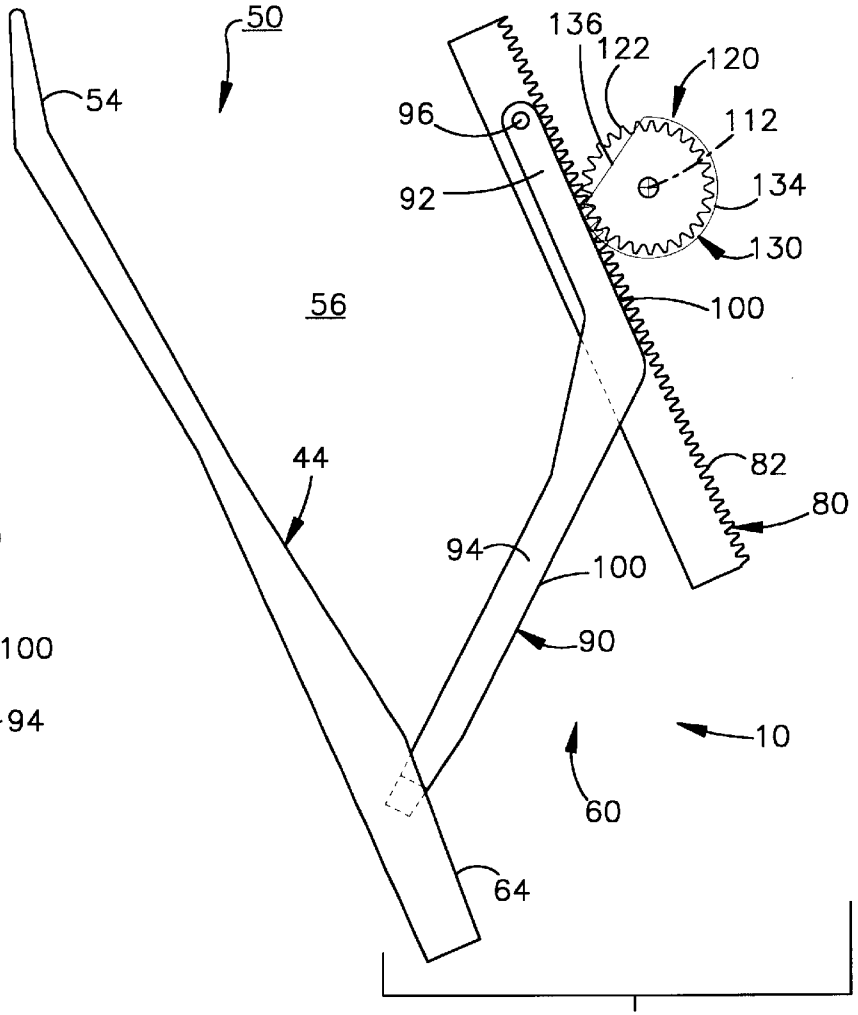

The rack 80 moves upwardly at least to a predetermined "closed-low" position as seen in FIG. 6. During this upward movement, the rack 80 continues to pull the foot 90 upwardly also. The driver cam 130 continues to rotate and drives the foot 90 to pivot about the pivot pins 96 until the lower portion 94 of the foot engages or is disposed adjacent to the back wall 42 of the pocket 10. The tip of the lower portion 94 of the foot 90 may extend into an opening in the back wall 42 of the pocket 10.

At this point in the rotation of the driver cam 130, the lifting surface 100 on the foot 90 is riding on the arcuate cam surface 134 on the driver cam. Thus, continued rotation of the driver cam 130 past this point does not move the foot 90 farther in a direction toward the back wall 42 of the pocket 10. Instead, any continued upward movement of the rack 80 results only in upward movement of the foot 90 along the front and back walls 40 and 42 of the pocket 10, without further pivoting movement of the foot.

When the lower portions 94 of the feet 90 reach the back wall 42 of the pocket 10, the bottom wall 76 of the pocket 10 is closed. The lower end portion 60 of the pocket 10 is closed. The biasing force exerted by the biasing springs (not shown) acting between the feet 90 and the racks 80 holds the feet in the closed position relative to the racks. Sheet material which is, thereafter, deposited in the pocket 10 at the stations 30, 32 and 34 is blocked from movement out of the pocket through the lower end portion 60 of the pocket.

The ratchet 160 and the pawl 170 prevent the pocket 10 from opening. Specifically, the engagement of the pawl tooth 172 with the ratchet wheel 160 blocks rotation of the ratchet wheel in a counterclockwise direction as viewed in FIG. 11. This blocks rotation of the drive shaft 110 and the pinions 120 in the counterclockwise direction as viewed in FIG. 11. This blocks downward movement of the racks 80 and helps to hold the feet 90 in the closed position.

After a jacket is deposited in a pocket 10 at the jacket delivery station 30, the jacket must be opened at the opener station 32. For the jacket to be opened properly, the upper end of the jacket must be at a predetermined location (height) at the upper end portion 50 of the pocket 10. Therefore, it is desirable that the upper ends of sheet material items having different heights and which are deposited in the pocket 10 be at the same position relative to the upper end portion 50 of the pocket.

The adjustable bottom wall 76 of the pocket 10 provides this capability. The amount of rise of the lift cam 20 is selected so that the bottom wall 76 of the pocket 10, when in the closed condition, is at a desired distance spaced from the upper end portion 50 of the pocket. Thus, the upper end of sheet material which is deposited in the pocket 10 and which rests on the bottom wall 76 of the pocket is at the desired position relative to the upper end portion 50 of the pocket.

Figure 10:
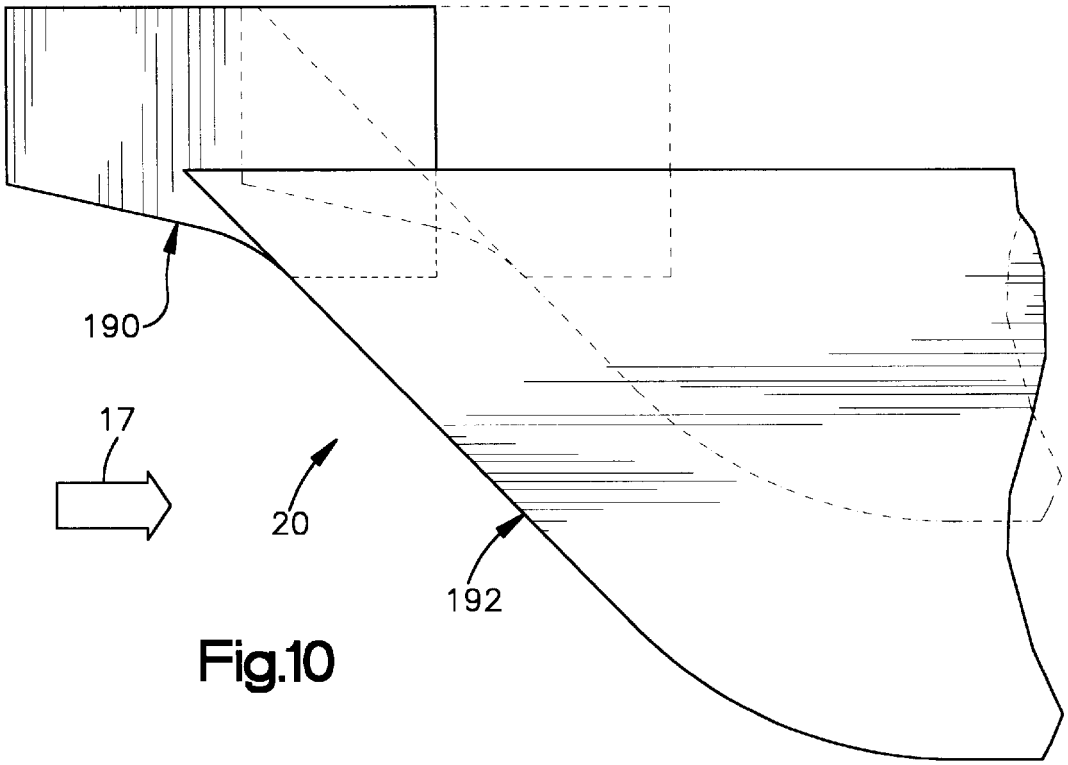
FIG. 10 is an enlarged schematic view of a portion of a lift cam forming part of the collating system of FIG. 1.

For example, if the movable portion 192 of the lift cam 20 is positioned relatively low, as seen schematically in solid lines in FIG. 10, then the lift cam 20 has a relatively great rise. The lift cam follower 156 on the sector gear 150 moves relatively far up upon engaging the lift cam 20. The sector gear 150 rotates by a relatively large amount about its axis of rotation 152. The drive gear 140, the drive shaft 110 and the pinion 120 also rotate by a relatively large amount, moving the rack 80 relatively far up along the front wall 40 of the pocket 10. The upward movement of the rack 80 causes the foot 90 to be pulled up to a "closed-high" location (FIG. 2) relatively close to the upper end portion 50 of the pocket 10. Relatively short sheet material can then be deposited in the pocket 10 and rest on the feet 90 with the upper end of the sheet material located at the desired position relative to the upper end portion 50 of the pocket.

If the movable portion 192 of the lift cam 20 is positioned relatively high, as seen schematically in dashed lines in FIG. 10, then the lift cam 20 has a relatively short rise. The lift cam follower 156 on the sector gear 150 experiences relatively less upward movement upon engaging the lift cam. The parts of the gear train including the sector gear 150, the drive gear 140, and the pinion 120 also, consequently, rotate less. The rack 80 does not move so far upward along the front wall 40 of the pocket 10. The foot 90 assumes a position relatively far from the upper end portion 50 of the pocket 10. Relatively tall sheet material can then be deposited in the pocket 10 and rest on the feet 90 with the upper end of the sheet material located at the desired position relative to the upper end portion 50 of the pocket.

Figure 8:
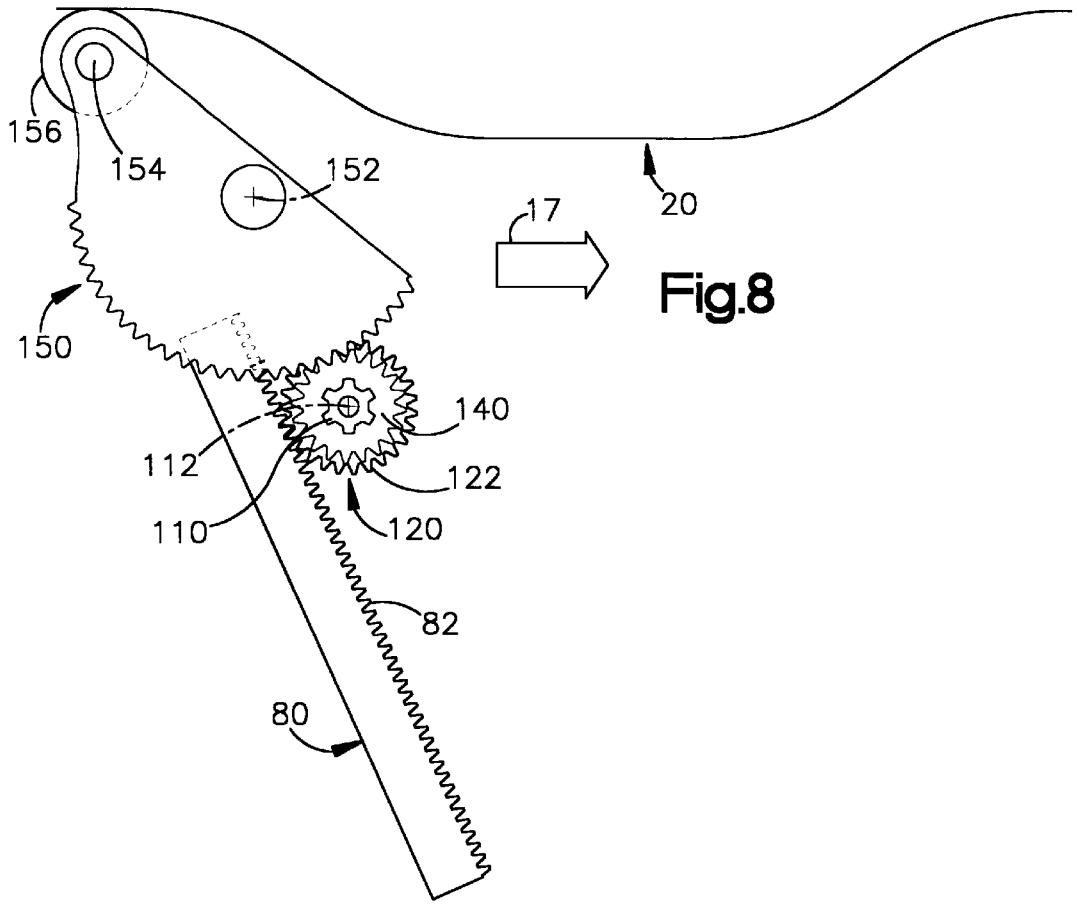
FIGS. 8 and 9 are schematic views illustrating the cam actuated closing of the pocket.
Figure 9:
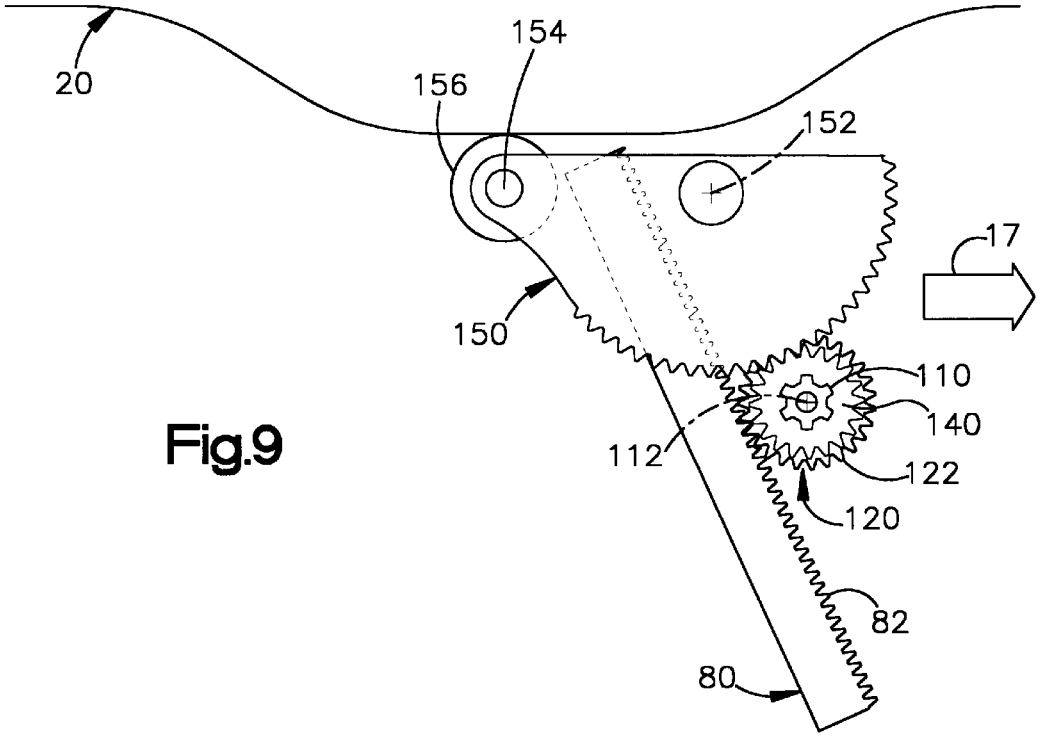

The lift cam 20 illustrated in FIGS. 8 and 9 is operational to rotate the sector gear 150 by about 45 degrees. This amount of rotation is sufficient to raise the rack 80 somewhat past the closed-low position shown in FIG. 7. In order to raise the rack 80 to the closed-high position shown in FIG. 2, the lift cam 20 would be set to have a rise sufficient to rotate the sector gear 150 by about 100 degrees or so. This amount of rise for the lift cam 20 is not shown in the drawings, for clarity.

The lift cam 20 is adjustable "on the fly". That is, the amount of rise of the lift cam 20 is adjustable while the collating system 12 is running and the pockets 10 are travelling along the loop 16. The collating system 12 does not have to be stopped to adjust the pockets 10 or to change any other part of the system, in order to accommodate sheet material of a different height.

The adjustment of the lift cam 20, shown schematically in FIG. 10, can be accomplished in different manners. The lift cam 20 may, for example, be adjustable in the manner shown in U.S. Pat. No. 5,527,025 dated Jun. 18, 1996. The lift cam 20 may, alternatively, be adjustable in other manners, such as by providing a plurality of different inserts for a fixed base, each of the inserts having a different amount of rise.

Figure 12:
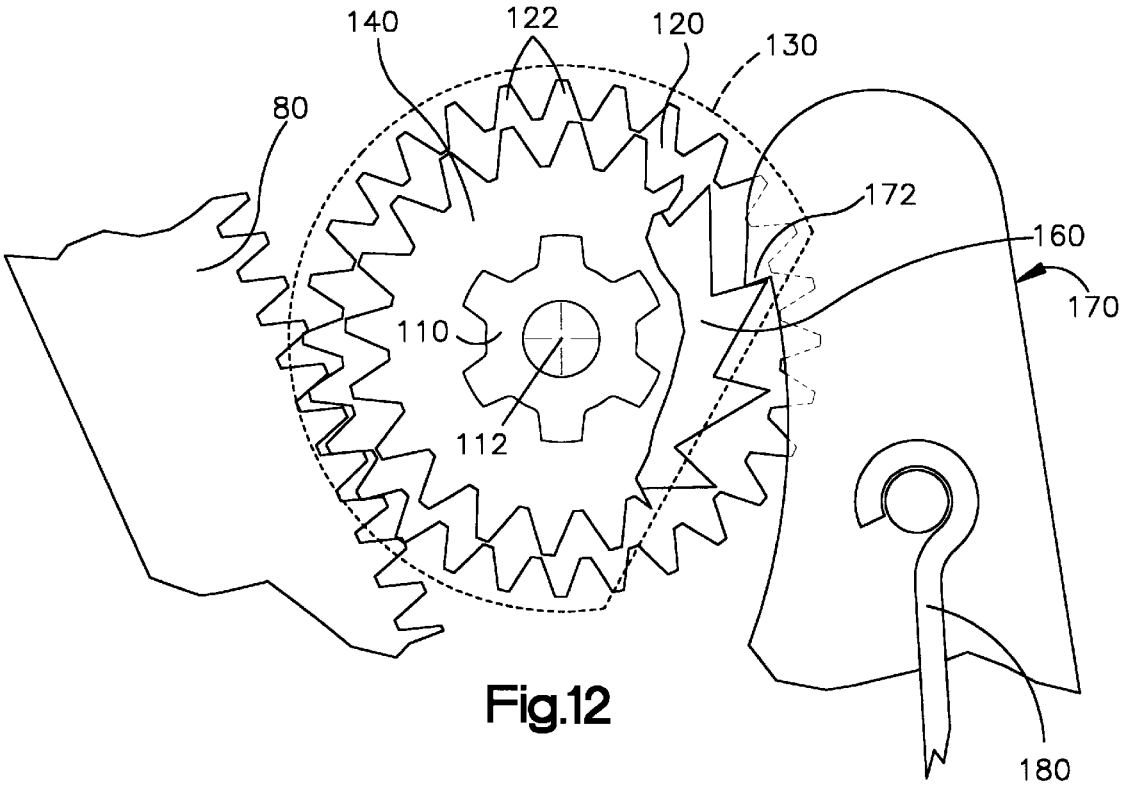

After a pocket 10 moves past the stations 30, 32 and 34, the pocket reaches the release station 36 (FIG. 1). The trip cam follower 176 on the pawl 170 (FIGS. 11–13) on the moving pocket 10 engages the trip cam 22 located at the release station 36. The trip cam follower 176 moves upward and the pawl 170 pivots out of the engaged position. The pawl tooth 172 moves out of engagement with the ratchet wheel 160. The overcenter spring 180 holds the pawl 170 in the disengaged position.

The pawl 170 no longer blocks rotation of the ratchet wheel 160 in a direction which would allow downward movement of the rack 80. The biasing force exerted on the sector gear 150 by the biasing spring 158 causes the sector gear to rotate in a clockwise direction as viewed in FIG. 2. The rotation of the sector gear 150 is transmitted through the drive gear 140 and through the drive shaft 110 to the pinion 120. The pinion 120 rotates in a direction so as to drive the rack 80 downward along the front wall 40 of the pocket 10.

As the rack 80 moves down, the foot 90, which is pinned to the rack, moves down also. After a predetermined amount of downward movement of the rack 80, the driver cam 130, which is rotating with the pinion 120, rotates sufficiently relative to the lifting surface 100 on the foot 90 so that the planar cam surface 136 on the driver cam again engages the lifting rib. Further rotation of the driver cam 130 causes the foot 90 to pivot away from the back wall 42 of the pocket 10, to the open position shown in FIG. 5. The bottom wall 76 of the pocket 10 is open. The lower end portion 60 of the pocket 10 is open. Sheet material in the pocket 10 can drop or move out of the pocket through the lower end portion 60 of the pocket.

After the pocket 10 moves past the release station 36, the pocket moves in the direction 17 to the location of the pawl reset cam 24 shown schematically in FIG. 1. The trip cam follower 176 on the pawl 170 engages the pawl reset cam 24. The trip cam follower 176 moves downward and the pawl 170 pivots from the disengaged position to the engaged position. The pawl tooth 172 moves into engagement with the ratchet wheel 160. The overcenter spring 180 holds the pawl 170 in the engaged position. When the pocket 10 subsequently moves past the lift cam 22, the pawl 170 is in a condition to block rotation of the ratchet wheel 160 in a direction which would allow downward movement of the rack 80.

From the above description of the invention, those skilled in the art will perceive improvements, changes and modifications in the invention. Such improvements, changes and modifications within the skill of the art are intended to be covered by the appended claims.

Having described the invention, I claim:

1. A sheet material conveying apparatus comprising:

a plurality of sheet material feeders;

a plurality of pockets movable past each of said sheet material feeders in turn to sequentially feed sheet material into said pockets, each pocket including a cam follower supported for movement on said pocket; and a cam engageable by said cam follower to effect movement of said cam follower on said pocket;

each one of said pockets having an upper end portion through which sheet material enters said one pocket, a lower end portion through which sheet material leaves said one pocket, and a support which supports sheet material in said one pocket;

said support being movable between a plurality of closed positions in which said support is spaced different distances from said upper end portion of said one pocket and at least partially blocks said lower end portion of said one pocket;

said support being movable from each of said closed positions to an open position in which sheet material is movable out of said pocket through said lower end portion of said pocket; and gear drive means for effecting movement of said support from the open position to a selected one of said closed positions in response to movement of said cam follower on said pocket;

said gear drive means comprising a rack, a pinion in meshing engagement with said rack, and means for effecting relative movement between said rack and said pinion to move said support between each of said closed positions and said open position.

2. An apparatus as set forth in claim 1 comprising a D-shaped cam member having a outer peripheral cam surface engageable with said support for moving said support at least partially between said open position and each of said closed positions, said cam surface including an arcuate portion and a flat portion, said arcuate portion of said cam surface being engageable with said support during movement of said support between each of the closed positions, said flat portion of said cam surface being engageable with said support during at least a portion of the movement of said support between the open position and each of the closed positions.

3. An apparatus as set forth in claim 1 wherein said gear drive means comprises a first gear connected for movement with said cam follower and a second gear in meshing engagement with said first gear, said pinion being connected for movement with said second gear.

4. A sheet material conveying apparatus comprising:

a plurality of sheet material feeders;

a plurality of pockets movable past each of said sheet material feeders in turn to sequentially feed sheet material into said pockets, each pocket including a cam follower supported for movement on said pocket; and a cam engageable by said cam follower to effect movement of said cam follower on said pocket;

each one of said pockets having an upper end portion through which sheet material enters said one pocket, a lower end portion through which sheet material leaves said one pocket, and a support which supports sheet material in said one pocket;

said support being movable between a plurality of closed positions in which said support is spaced different distances from said upper end portion of said one pocket and at least partially blocks said lower end portion of said one pocket;

said support being movable from each of said closed positions to an open position in which sheet material is movable out of said pocket through said lower end portion of said pocket; and gear drive means for effecting movement of said support from the open position to a selected one of said closed positions in response to movement of said cam follower on said pocket;

said gear drive means comprising a rack supported for sliding movement on said pocket, said support being connected with said rack for sliding movement with said rack.

5. An apparatus as set forth in claim 4 including means for mounting said support on said rack for pivotal movement relative to said rack.

6. A sheet material conveying apparatus comprising:

a plurality of sheet material feeders;

a plurality of pockets movable past each of said sheet material feeders in turn to sequentially feed sheet material into said pockets, each pocket including a cam follower supported for movement on said pocket; and a cam engageable by said cam follower to effect movement of said cam follower on said pocket;

each one of said pockets having an upper end portion through which sheet material enters said one pocket, a lower end portion through which sheet material leaves said one pocket, and a support which supports sheet material in said one pocket;

said support being movable between a plurality of closed positions in which said support is spaced different distances from said upper end portion of said one pocket and at least partially blocks said lower end portion of said one pocket;

said support being movable from each of said closed positions to an open position in which sheet material is movable out of said pocket through said lower end portion of said pocket; and gear drive means for effecting movement of said support from the open position to a selected one of said closed positions in response to movement of said cam follower on said pocket;

said gear drive means further comprising a D-shaped cam member having an outer peripheral cam surface engageable with said support for moving said support at least partially between said open position and each of said closed positions, said cam surface including an arcuate portion and a flat portion, said arcuate portion of said cam surface being engageable with said support during movement of said support between each of the closed positions, said flat portion of said cam surface being engageable with said support during at least a portion of the movement of said support between the open position and each of the closed positions.

7. A sheet material handling apparatus comprising:

a plurality of sheet material feeders;

a plurality of pockets movable past each of said sheet material feeders in turn to sequentially feed sheet material into said pockets;

each one of said pockets having an upper end portion through which sheet material enters said one pocket, a lower end portion through which sheet material leaves said one pocket, and a support which supports sheet material in said one pocket;

said support being movable between a plurality of closed positions in which said support is spaced different distances from said upper end portion of said one pocket and at least partially blocks said lower end portion of said one pocket;

said support being movable from each of said closed positions to an open position in which sheet material is movable out of said pocket through said lower end portion of said pocket; and means for moving said support between each of said closed positions and said open position, comprising a rack, a pinion in meshing engagement with said rack, and means for effecting relative movement between said rack and said pinion to move said support between each of said closed positions and said open position.

8. An apparatus as set forth in claim 7 wherein said support comprises a member which is supported on said rack for pivotal movement relative to said rack between said open position and said closed positions.

9. An apparatus as set forth in claim 8 wherein said rack is supported on said pocket for sliding movement, said member moving between different ones of said closed positions in response to sliding movement of said rack.

10. An apparatus as set forth in claim 7 wherein said means for effecting relative movement between said rack and said pinion comprises:

a cam follower on said pocket;

means connected between said pinion and said cam follower for rotating said pinion in response to movement of said cam follower, said rack being movable in response to rotation of said pinion to move said support between each of said closed positions and said open position; and a cam engageable by said cam follower to effect movement of said cam follower thereby to effect rotation of said pinion.

11. An apparatus as set forth in claim 10 wherein said means connected between said pinion and said cam follower for rotating said pinion in response to movement of said cam follower comprises:

a shaft rotatable about a first axis, said pinion being rotatable with said shaft about said first axis;

a drive gear rotatable with said shaft about said first axis; and an actuator gear movable with said cam follower about a second axis spaced from said first axis, said actuator gear being in meshing engagement with said drive gear.

12. An apparatus as set forth in claim 7 comprising a D-shaped cam member having a outer peripheral cam surface engageable with said support for at least partially moving said support between said open position and each of said closed positions, said cam surface including an arcuate portion and a planar portion, said arcuate portion of said cam surface being engageable with said support during movement of said support between each of the closed positions, said planar portion of said cam surface being engageable with said support during at least a portion of the movement of said support between the open position and each of the closed positions.

13. An apparatus as set forth in claim 11 wherein said planar portion of said cam surface is in engagement with said support during at least a portion of the movement of said support from the open position to each of the closed positions.

* * * * *

UNITED STATES PATENT AND TRADEMARK OFFICE

CERTIFICATE OF CORRECTION

PATENT NO. : 5,911,416
DATED : June 15, 1999
INVENTOR(S) : Andrew L. Klopfenstein It is certified that error appears in the above-indentified patent and that said Letters Patent is hereby corrected as shown below:

Column 12, line 11, change "11" to "12"

Signed and Sealed this

Seventeenth Day of October, 2000

*Attest:*

Q. TODD DICKINSON

*Attesting Officer*

*Director of Patents and Trademarks*